US005957954A

United States Patent [19]

Badalamenti et al.

[11] Patent Number: 5,957,954

[45] Date of Patent: Sep. 28, 1999

[54] TEETHING GEL APPLICATOR

[75] Inventors: Michael J. Badalamenti, Aurora; Mark A. Sedlack, Cuyahoga Falls, both of Ohio

[73] Assignee: Michael J. Badalamenti, Aurora, Ohio

[21] Appl. No.: 09/047,714

[22] Filed: Mar. 25, 1998

[51] Int. Cl.[6] ..... A61J 17/00

[52] U.S. Cl. ..... 606/235; 606/234; 606/151; 606/75

[58] Field of Search ..... 606/235, 234; 374/151; 426/75

[56] References Cited

U.S. PATENT DOCUMENTS

| | | | |
|---|---|---|---|
| D. 136,206 | 8/1943 | Allen . | |
| 2,705,011 | 3/1955 | Newton . | |
| 3,669,117 | 6/1972 | Herbst | 606/235 |
| 5,013,321 | 5/1991 | MacVane . | |
| 5,122,056 | 6/1992 | Barbee . | |
| 5,211,559 | 5/1993 | Hart et al. . | |
| 5,403,349 | 4/1995 | Rohrig | 606/234 |
| 5,810,886 | 9/1998 | Hassan | 606/234 |

*Primary Examiner*—Michael Buiz
*Assistant Examiner*—(Jackie) Tan-Uyen T. Ho
*Attorney, Agent, or Firm*—Pearne, Gordon, McCoy & Granger LLP

[57] ABSTRACT

A teething gel applicator including a teether. The teether has a chewing portion sized to be partially inserted into a child's mouth. The teether has a series of depressions for holding a gel. A handle, sized to be grasped by a child, is connected to the chewing portion. A gel spreader, that is removably secured to the chewing portion, is used to fill the depressions with the gel. The gel spreader receives a vial containing the gel and rotates around the chewing portion to deposit the gel in the depressions.

20 Claims, 2 Drawing Sheets

TEETHING GEL APPLICATOR

BACKGROUND OF THE INVENTION

The present invention generally relates to child care devices. More specifically, the present invention relates to a device for applying soothing gel to a teething child's gums.

Teething is the physiological process of tooth eruption through the gums of the mouth, and typically begins between the ages of four and eight months. Once teething commences, it continues until all twenty childhood teeth are in place at approximately thirty months. Some of the manifestations resulting from the discomfort of teething include drooling, irritability, sleeping problems and biting on hard objects. The discomfort is caused by the pressure erupting teeth place on the periodontal membrane. Pain can occur before visually perceptible eruption takes place.

There are presently several remedies for alleviating the discomfort associated with teething. These remedies include allowing the child to suck on a cool object such as a frozen teething ring. However, this quickly looses effectiveness as the object warms. Other remedies include children's pain relievers such as acetaminophen and ibuprofen. Also available are homeopathic medications, typically in the form of teething tablets. These remedies have significant drawbacks. Acetaminophen and ibuprofen are not recommended for children under two years old unless directed by a physician. Relief is also delayed until the drug travels through the bloodstream and takes effect. Another remedy is applying a topical anesthetic, such as benzocaine, to the affected area. However, topical products are difficult to apply in the correct dosage to the affected areas since they are currently applied with a fingertip, a cotton applicator or a needleless syringe. Often, the administrator must guess where the child's pain is, especially before visually perceptible eruption occurs.

SUMMARY OF THE INVENTION

The present invention overcomes these disadvantages by providing a teething gel applicator including a teether. The teether has a chewing portion sized to be partially inserted into a child's mouth. The teether has a series of depressions for holding a gel. A handle, sized to be grasped by a child, is connected to the chewing portion.

BRIEF DESCRIPTION OF THE DRAWINGS

These and further features of the present invention will be apparent with reference to the following description and drawings, wherein.

DETAILED DESCRIPTION OF THE PREFERRED EMBODIMENTS OF THE INVENTION

Figure 1:
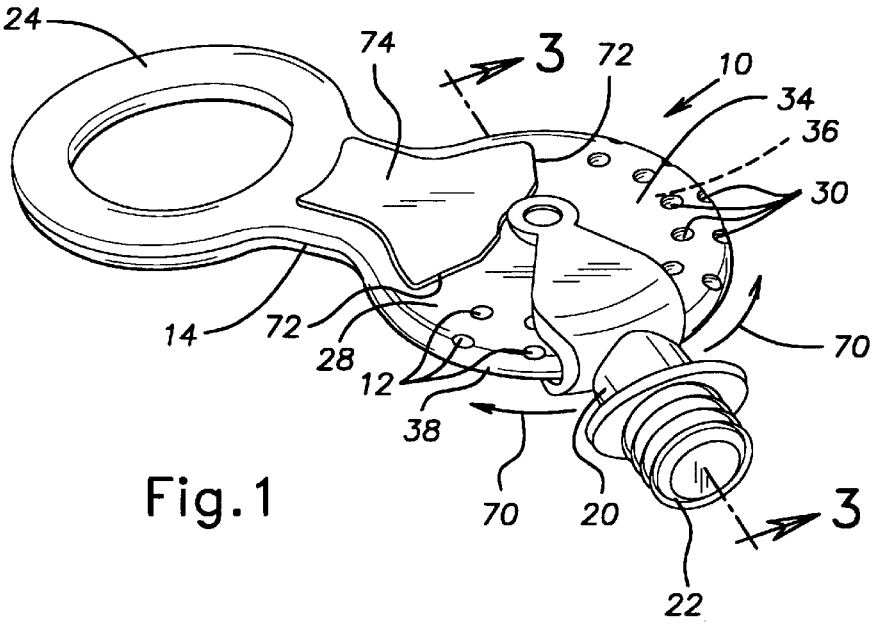
FIG. 1 is a perspective view of a teething gel applicator according to the present invention.

In the detailed description which follows, identical components have been given the same reference numerals, and, in order to clearly and concisely illustrate the present invention, certain features may be shown in somewhat schematic form. When a preferred range, such as 5 to 25 is given, this means preferably at least 5 and preferably not more than 25.

Figure 2:
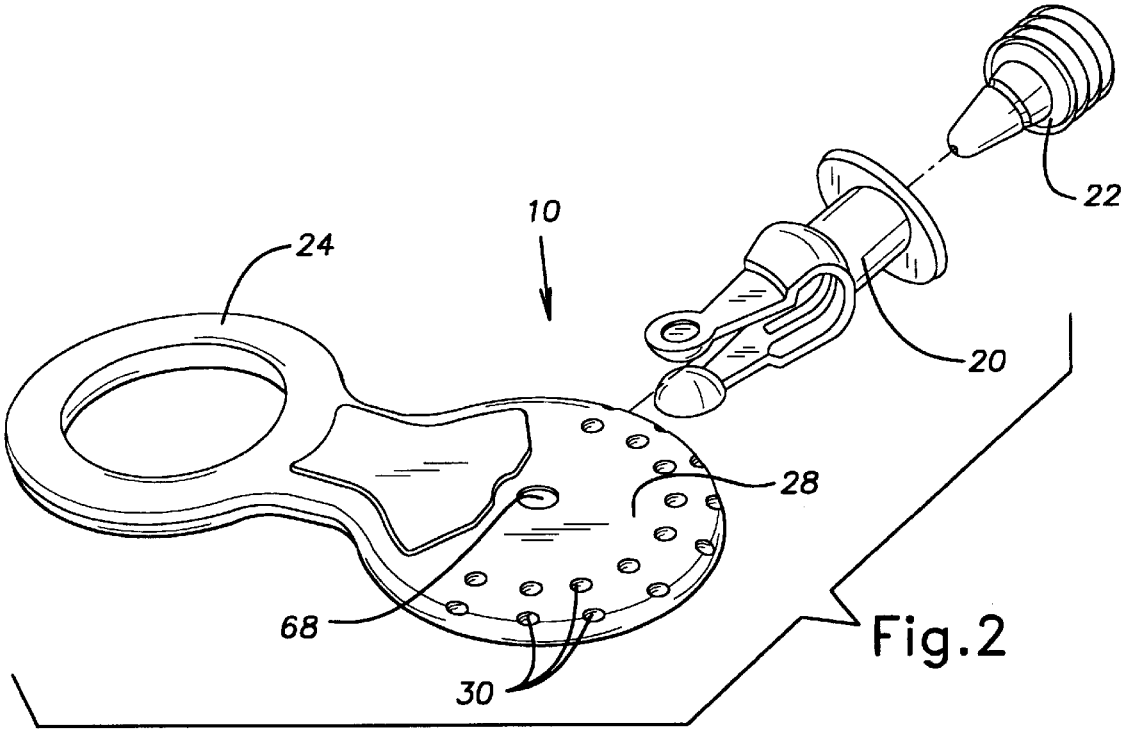
FIG. 2 is an exploded perspective view of the teething gel applicator.

Referring to FIGS. 1 and 2, a teething gel applicator 10 is shown. The teething gel applicator 10 is a device used to dispense an exact amount of medication 12 to a teething child's erupted or pre-erupted gum area. Generally, the teething gel applicator 10 provides a teether 14, an applicator or gel spreader 20, and a gel container or vial 22. The teether 14 has a handle 24 and a chewing portion 28 outfitted with depressions or dimples 30 used to hold the medication 12.

The teething gel applicator 10 takes advantage of the fact that a teething child will naturally take an object and direct it to an affected area in his or her mouth. Accordingly, the child can help in applying medication to a painful place in his or her mouth by chewing on the medicated chewing portion 28 of the teether 14. The handle 24 is provided to assist the child in holding the teether 14 and directing the chewing portion 28 to the correct location. Thus, the handle 24 has a shape that is easily grasped and held by an infant or toddler. For example, the handle 24 may be cylindrically shaped, or ring or toriodal shaped as shown in FIGS. 1 and 2.

The chewing portion 28 is preferably circular in shape and has a top surface 34, a bottom surface 36 and an edge 38. The edge 38 is rounded over to form a continuously smooth surface extending from the top 34 to the bottom 36 surfaces. As mentioned, the chewing portion 28 is provided with a series of dimples 30. Each dimple 30 is preferably hemispherically shaped and about 1.5 to 6 mm in diameter, more preferably 2 to 3 mm in diameter, and about 0.5 to 3 mm in depth, more preferably 1 to 1.5 mm in depth. The dimples are arranged on both the top 34 and bottom 36 surfaces, and are located adjacent the rounded edge 38. Some of the dimples 30 are preferably located on the curved surfaces between the top surface 34 and edge 38, and bottom surface 36 and edge 38 respectively (best seen in FIG. 3).

The dimples 30 hold the medication 12 by surface tension. The preferred medication 12 for use with the teething gel applicator 10 is a gel preparation containing 7% benzocaine to act as a topical anesthetic. Other known anesthetic gels may be used. The dosage is determined by the volume of the dimples 30. Since the amount of medication 12 dispensed is determined unobjectively, an exact amount of medication 12 is dispensed to the child. With prior applicators, exceeding the recommended dosage of teething medication applied to the child's gums is a common event. Over-medication is often caused by misreading an applicator's dosage markings and/or from applying medication to the entire mouth when the child's pain is localized.

Since the teether 14 is intended to be inserted partially in a child's mouth by the child, the teether 14 is preferably made of lightweight, non-toxic and dishwasher safe plastic that will not easily chip, splinter, crack or otherwise tear apart. The teether 14 is preferably made of sturdy, one piece construction. Furthermore, the diameter and thickness of the chewing portion 28 are sized to partially fit in a child's mouth and deliver medication 12 to the child's gums, but is too large to be completely inserted into the child's mouth. The chewing portion 28 preferably has a diameter of about 40 to 80 mm, more preferably about 50 to 60 mm, and a thickness of 6 to 12 mm, more preferably 7 to 10 mm. In length, the teether 14 is preferably about 100 to 180 mm, more preferably about 110 to 120 mm, long. For a ring shaped handle 24, the dimensions of the handle are preferably proportional to the chewing portion 28. Accordingly, the exterior diameter of the handle 24 is preferably about 40 to 80 mm, more preferably 50 to 60 mm, and the thickness is preferably 6 to 12 mm, more preferably 7 to 10 mm. The interior diameter of the handle 24 is of cooperating dimension, preferably 28 to 46 mm, more preferably 36 to 40 mm.

Figure 3:
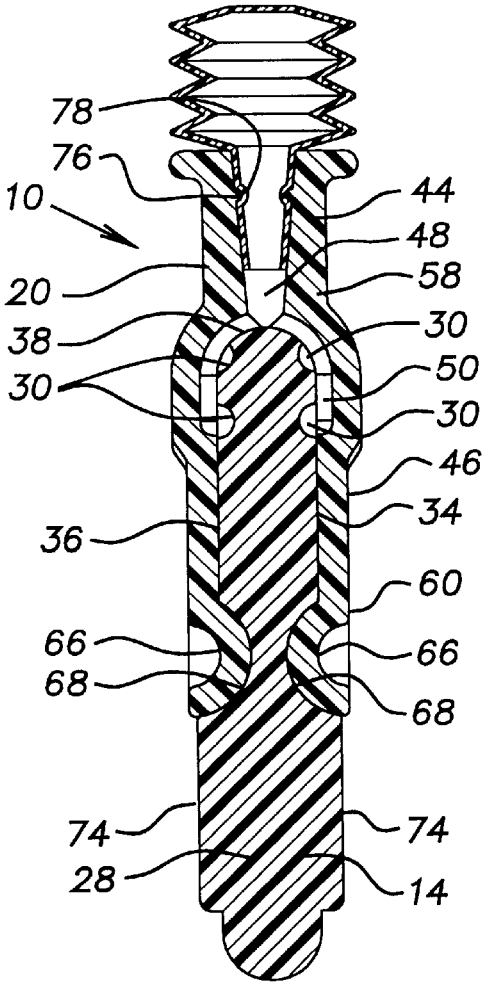
FIG. 3 is a cross sectional view of the teething gel applicator along the line 3—3 in FIG. 1.
Figure 4:
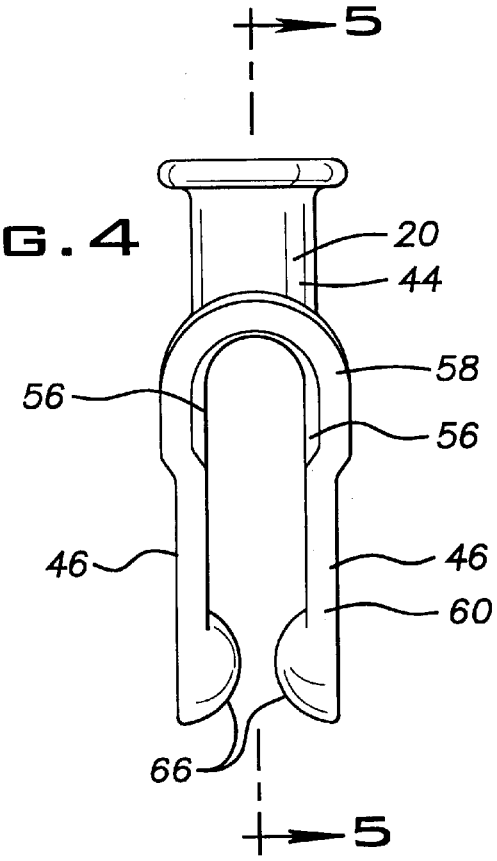
FIG. 4 is an elevational view of a gel spreader for use with the teething gel applicator.

As stated, the teething gel applicator 10 is provided with a gel spreader 20. Referring now to all of the figures, the gel spreader 20 is used to fill the dimples 30 with medication 12 originating from the vial 22. The gel spreader 20, which is preferably made from plastic, is provided with a head portion 44, spaced apart forks 46, a gel entry channel or vial retaining channel 48, a gel dispensing channel 50 and a wiper 56. The forks 46 are arranged parallel to one another and have proximal 58 and distal 60 ends. The forks 46 are connected to the head 44 at the proximal 58 ends of the forks 46. The distal ends 60 of the forks 46 are provided with inwardly directed projections 66 adapted to engage indentations 68 (FIGS. 2 and 3) defined by the top 34 and bottom 36 surfaces of the chewing portion 28. The forks 46 are outwardly displaceable so that the gel spreader 20 may be snap fit onto the teether 14 as shown in FIGS. 1 and 3, and removed as shown in FIG. 2.

More specifically, the projections 66 are semi-spherical. When the projections 66 are placed against the edge 38 of the chewing portion 28 and the gel spreader 20 is pushed towards the center of the chewing portion 28, the curved edge 38 of the chewing section 28 displaces the projections 66 by flexing the forks 46 away from the top 34 and bottom 36 surfaces. The projections 66 then travel along the respective top 34 and bottoms 36 surfaces until the projections 66 are received into the indentations 68 and the gel spreader 20 snaps into place. To remove the gel spreader 20, the gel spreader 20 is pulled away from the teether 14 in an opposite fashion.

The projections 66 also serve to provide a pivot point for the gel spreader 20. Accordingly, the indentations 68 are preferably placed at the center of the chewing portion 28 so that the gel spreader 20 will rotate in a circular path around the chewing potion as shown by arrows 70 in FIG. 1. The gel spreader 20 will travel completely around the chewing portion 28 until the head 44 contacts the handle 24. In order to further limit rotational travel of the gel spreader 20 the teether 14 is provided with stop surfaces 72 formed by a raised portion 74 on the teether 14. The stop surfaces 72 engage the sides of the forks 46.

The head portion 44 of the gel spreader 20 defines the vial retaining channel 48. The vial retaining channel 48 is in communication with the gel dispensing channel 50, which is defined by the forks 46, the wiper 56 and the chewing portion 28. In order to dispense medication 12 from the vial 22 to the dimples 30, the gel spreader 20 is attached to the chewing portion 28. The vial 22 containing the medication 12 is then inserted into the vial retaining channel 48. The vial 22 may be held in the vial retaining channel 48 by pressure applied by a person operating the teething gel applicator 10, by friction, or preferably by corresponding tabs 76 and recesses 78 provided on the vial retaining channel 48 and the vial 22 (FIG. 3) respectively, these being some of the means to retain the vial 22. One skilled in the art will appreciate that the tabs 76 can also be in the form of ridges, bumps or the like and could be located on either the interior surface of the vial retaining channel 48 or the exterior surface of the vial 22 with equivalent results. Likewise, the vial 22 can threadably engage the vial retaining channel 48.

The vial 22 is squeezed so as to force the medication 12 out of the vial 22, into the vial retaining channel 48 and into the gel dispensing channel 50. The gel spreader 20 is rotated around the chewing portion 28 so that medication 12 will be deposited in the dimples 30. Should additional medication 12 be required to fill all the dimples 30 as the gel spreader 20 rotates around the chewing section, the vial 22 may be simultaneously or periodically squeezed.

Figure 5:
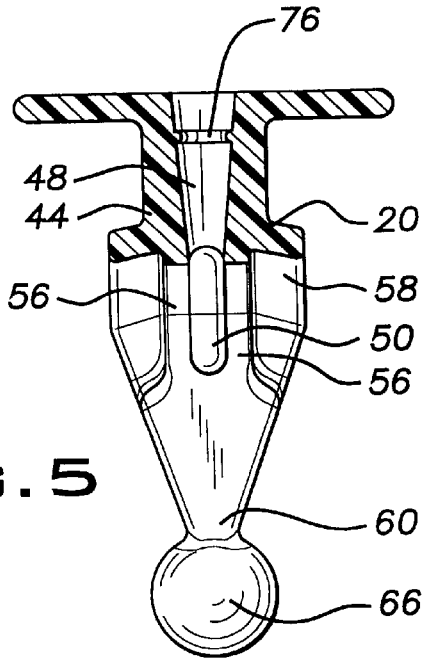
FIG. 5 is a cross sectional view of the gel spreader along the line 5—5 in FIG. 4.

Referring to FIG. 5, the wiper 56 is disposed on the interior sides of the forks 46 so that the wiper 56 circumscribes the gel dispensing channel 50, except in the area where the vial retaining channel 48 communicates with the gel dispensing channel 50. The wiper 56 prevents excess medication 12 from being deposited on the top surface 34, bottom surface 36, or edge 38 of the chewing portion 28 as the gel spreader 20 is rotated. It should be understood that the gel dispensing channel 50 is preferably located on both forks 46 so that medication 12 will be deposited into dimples 30 on both the top 34 and bottom 36 surfaces of the teether 14.

The shape of the vial 22 is not critical, but the vial 22 must be able to dispense medication 12 into the gel spreader 20. Accordingly, examples of suitable vials 22 include a squeezable tube similar to a toothpaste tube or a collapsible corrugated tube as shown in FIGS. 1 through 3. The vial 22 is preferably provided with a cap (not shown). The cap can be provided with a pull ring for removing the cap from the vial 22.

Although particular embodiments of the invention have been described in detail, it is understood that the invention is not limited correspondingly in scope, but includes all changes and modifications coming within the spirit and terms of the claims appended hereto.

What is claimed is:

1. A teething gel applicator comprising a teether and a gel spreader, said teether having a chewing portion connected to a handle, said chewing portion sized to be partially inserted into a child's mouth and defining a plurality of depressions for holding a gel, said handle sized to be grasped by the child, said gel spreader being mechanically connected to said teether in such a way that said spreader is moveable across the portion of the teether having said depressions so that said gel may be spread into said depressions.

2. The teething gel applicator according to claim 1, wherein the chewing portion has a top surface, a bottom surface and an edge, the edge being rounded to form a continuously smooth surface extending from the top to the bottom surface, each of said plurality of depressions holding an anesthetic gel.

3. The teething gel applicator according to claim 2, wherein the depressions are located on the top and bottom surfaces adjacent the rounded edge.

4. The teething gel applicator according to claim 1, the chewing portion being circular and having a center, the gel spreader being attached to the center of the chewing portion allowing the gel spreader to rotate in a circular path around the chewing portion.

5. The teething gel applicator according to claim 1, wherein the gel spreader is removably attached to the chewing portion.

6. The teething gel applicator according to claim 5, wherein the gel spreader has a fork for attaching the gel spreader to the chewing portion.

7. The teething gel applicator according to claim 6, wherein the fork is provided with a wiper and a fork defines a gel dispensing channel.

8. The teething gel applicator according to claim 1, said gel spreader having a gel entry channel, said gel entry channel being adapted to receive a vial for forcing gel into the gel entry channel.

9. The teething gel applicator according to claim 8, wherein the gel entry channel is provided with a means to retain the vial.

10. The teething gel applicator according to claim 1, said gel spreader having a head and at least one fork, the head defining a gel entry channel, the fork having a proximal end and a distal end, and the fork being connected to the head by the proximal end, and the distal end removably engaging the chewing portion.

11. The teething gel applicator according to claim 10, wherein the distal end has an inwardly directed projection for removably engaging an indentation defined by the chewing portion.

12. The teething gel applicator according to claim 11, wherein the chewing portion is circular and has a center, and the indentation is located in the center allowing the gel spreader to rotate in a circular path around the chewing portion.

13. The teething gel applicator according to claim 10, wherein the fork is provided with a wiper and the fork defines a gel dispensing channel, the gel dispensing channel being in communication with the gel entry channel.

14. The teething gel applicator according to claim 13, wherein the wiper circumscribes the gel dispensing channel.

15. The teething gel applicator according to claim 12, wherein the teether is provided with stop surfaces to limit rotational travel of the gel spreader.

16. The teething gel applicator according to claim 1, wherein said gel spreader is removably connected to said teether.

17. The teething gel applicator according to claim 1, wherein said gel spreader is removably and reattachably connected to said teether.

18. The teething gel applicator according to claim 1, wherein said gel spreader has a pair of spaced apart forks, said gel spreader being mechanically connected to said teether by said pair of forks engaging opposing surfaces of said chewing portion.

19. The teething gel applicator according to claim 18, each of said pair of forks removably engaging an indentation in said chewing portion, at least one of said forks being flexible.

20. The teething gel applicator according to claim 1, further comprising a vial attached to said gel spreader, said vial containing an anesthetic gel, said vial and spreader being adapted to spread anesthetic gel into said depressions.

* * * * *